US011846146B2

(12) United States Patent
Van Duivendijk et al.

(10) Patent No.: US 11,846,146 B2
(45) Date of Patent: Dec. 19, 2023

(54) POWER TONG

(71) Applicant: ITREC B.V., Schiedam (NL)

(72) Inventors: Pieter Dirk Melis Van Duivendijk, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 493 days.

(21) Appl. No.: 17/265,427

(22) PCT Filed: Jul. 25, 2019

(86) PCT No.: PCT/NL2019/050483

§ 371 (c)(1),
(2) Date: Feb. 2, 2021

(87) PCT Pub. No.: WO2020/027654

PCT Pub. Date: Feb. 6, 2020

(65) Prior Publication Data

US 2021/0293100 A1 Sep. 23, 2021

(30) Foreign Application Priority Data

Aug. 3, 2018 (NL) ..... 2021418

(51) Int. Cl.
*E21B 19/16* (2006.01)

(52) U.S. Cl.
CPC ..... *E21B 19/163* (2013.01); *E21B 19/164* (2013.01); *E21B 19/168* (2013.01)

(58) Field of Classification Search
CPC ..... E21B 19/163; E21B 19/164; E21B 19/168
See application file for complete search history.

(56) References Cited

U.S. PATENT DOCUMENTS 10,550,651 B2 * 2/2020 Webb ..... E21B 19/163
2002/0157823 A1 10/2002 Pietras et al.
(Continued)

FOREIGN PATENT DOCUMENTS

CA 2 547 944 A1 5/2001
CA 2 621 570 A1 8/2009
(Continued)

OTHER PUBLICATIONS

Dutch Search Report, issued in Priority Application No. 2021418, dated Mar. 22, 2019.
(Continued)

*Primary Examiner* — David B. Thomas
(74) *Attorney, Agent, or Firm* — Birch, Stewart, Kolasch & Birch, LLP

(57) ABSTRACT

A power tong includes a lower tong and an upper tong, each with multiple grippers distributed around a tubular passage, for gripping a lower tubular and ripping an upper tubular respectively. A torque actuator includes a first hydraulic drive and a second hydraulic drive, for rotating the upper tong relative to the lower tong. The first hydraulic drive and the second hydraulic drive each have a drive shaft that supports a guide wheel for cooperating with a guide track, and a pinion for cooperating with a rack, which guide wheel and pinion are concentrically, mounted on the drive shaft of the hydraulic drive. The hydraulic drives are mounted with the drive shafts parallel to the main axis, and the upper tong or the lower tong comprises a guide track receiving the guide wheel and a rack cooperating with the pinion.

20 Claims, 6 Drawing Sheets

(56) References Cited

U.S. PATENT DOCUMENTS

| | | | | |
|---|---|---|---|---|
| 2010/0199812 | A1 | 8/2010 | Richardson | |
| 2011/0067529 | A1* | 3/2011 | Pietras | E21B 19/164 166/250.01 |
| 2015/0101826 | A1 | 4/2015 | Gupta et al. | |

FOREIGN PATENT DOCUMENTS

| | | | |
|---|---|---|---|
| CN | 204920785 | U | 12/2015 |
| GB | 2 356 591 | A | 5/2001 |
| RO | 120721 | B1 | 6/2006 |
| WO | WO 2013/022352 | A1 | 2/2013 |
| WO | WO 2016/187702 | A1 | 12/2016 |

OTHER PUBLICATIONS

International Search Report, issued in PCT/NL2019/050483, dated Sep. 20, 2019.
Written Opinion of the International Searching Authority, issued in PCT/NL2019/050483, dated Sep. 20, 2019.

* cited by examiner

POWER TONG

FIELD AND BACKGROUND OF THE INVENTION

The present invention generally relates to an power tong for connecting and disconnecting tubulars with threaded ends. Particularly, the present invention relates to a wrenching tool for use in making or breaking tubular connections, more in particular torque up and torque down a connection between two tubulars. More particularly still, the present invention relates to an alternative roughneck having a compact design. The invention furthermore provides a method and a vessel or platform provided with a power tong according to the invention.

It is submitted that power tongs are generally known in the prior art. Power tongs are wrenches used for connecting tubulars, for example for connecting drill pipe to compose a drill string, or for connecting tubular casing sections for providing a casing string for lining the inside of a well bore. More in particular, a power tong is used to torque up a connection between an upper tubular and a lower tubular, which tubulars are already connected by screwing a lower threaded end of the upper tubular into an upper threaded end of the lower tubular, and to torque down a connection between an upper tubular and a lower tubular, prior to the tubulars being disconnected by unscrewing the lower threaded end of the upper tubular out off the upper threaded end of the lower tubular.

In the construction of oil or gas wells it is usually necessary to construct long drill pipes. Due to the length of these pipes, sections or stands of tubulars are progressively added to the string of tubulars as it is lowered into the well from a drilling platform. In particular, when it is desired to add a section or stand of pipe the string is usually supported by applying slips of a spider located in the floor of the drilling platform. The new section or stand of pipe is then moved from a rack into the firing line above the spider. The threaded pin of the section or stand of pipe to be connected is then located over the threaded box of the pipe in the well and the connection is made up by rotating the stand or pipe relative to the string.

Typically, a spinner is used to make the connection between two tubulars, e.g. driving the threaded pin end of an upper tubular into the thread box end of a lower tubular. The power tong is subsequently used to torque up the connections between the tubulars.

The power tong rotates one tubular, which may be part of a stand of tubulars, relative to the other tubular, which may be part of a string of tubulars, to break out, or make-up a string of multiple casing sections, tubulars, drill pipes, and other tubulars. The make-up torque required relies for example on the size of the tubulars and the thread compound friction factor.

It is common practice to use a power tong to torque the connection up to a predetermined torque in order to make the connection. The power tong is located on the platform, either on rails, or hung from a derrick on a chain. In order to make up or break out a threaded connection, a two tong arrangement is necessary. An active (or wrenching) tong supplies torque to the section of pipe above the threaded connection, while a passive (or back up) tong supplies a reaction torque below the threaded connection. The back up tong clamps the pipe below the threaded connection, and prevents it from rotating. This clamping can be performed mechanically, hydraulically or pneumatically. The wrenching tong clamps the upper part of the connection and is driven so that it supplies torque for a limited angle.

Normally, in order to supply high torque, the wrenching tong is driven hydraulically. One or two hydraulic cylinders drive the tong through a small angle, typically in the region of 25°, depending on the tong design. Due to the geometric configuration normally used, the torque output of the tong changes as a sine function of the angle driven, which results in a reduction of torque output across the drive angle of up to 15%.

In order to make up or break out a connection, it may be necessary to provide a high torque over a large angle. To enable this, the wrenching tong must grip and wrench the tubular several times to tighten or break the threaded connection fully.

There is a need for an improved apparatus for making or breaking a tubular connection. Further, there is a need for a compact apparatus that will makeup or breakup a tubular connection.

SUMMARY OF THE INVENTION

According to the present invention there is provided a power tong according to claim 1, for applying torque to a lower tubular relative to a upper tubular, to thus connect and disconnect an upper wire end of the lower tubular and a lower threaded end of the upper tubular, the lower tubular and upper tubular being coaxially supported on a main axis of the power tong.

An power tong according to the invention comprises:

- a lower tong, the lower tong comprising a lower tong frame defining a central tubular passage, multiple grippers, each gripper having a linear working axis said working axis extending perpendicular to the main axis, which grippers are distributed around the tubular passage for gripping the lower tubular in the tubular passage, and a radial opening that provides lateral access to the tubular passage for a tubular;
- an upper tong, the upper tong comprising an upper tong frame defining a central tubular passage, multiple grippers, each gripper having a linear working axis said working axis extending perpendicular to the main axis, which grippers are distributed around the tubular passage for gripping the upper tubular in the tubular passage, and a radial opening that provides lateral access to the tubular passage;
- a support frame, the support frame supporting the lower tong and/or the upper tong with the respective tubular passage aligned on the main axis, the upper tong being located above the lower tong; and
- a torque actuator, the torque actuator comprising a first hydraulic drive and a second hydraulic drive, for rotating the upper tong relative to the lower tong and about the main axis, to connect or disconnect the lower tubular gripped by the lower tong and the upper tubular gripped by the upper tong, wherein the first hydraulic drive and the second hydraulic drive each have a housing and a drive shaft extending from that housing, wherein each drive shaft supports a guide wheel for cooperating with a guide track and a pinion for cooperating with a rack, which guide wheel and pinion are concentrically mounted on the drive shaft of the hydraulic drive, and wherein the first hydraulic drive and the second hydraulic drive are mounted on the lower tong frame or are mounted on the upper tong frame, each with the drive shaft parallel to the main axis, and wherein respectively the upper tong or the lower tong comprises the guide track receiving the guide wheel and the rack cooperating with the pinion of the first hydraulic drive and the second hydraulic drive, to enable the hydraulic drives to rotate and guide the upper tong relative to the lower tong.

Thus, the power tong comprises a lower tong for gripping the lower tubular and an upper tong for gripping the upper tubular, and is provided with a rack and pinion drive and a guide track for rotating the upper tong relative to the lower tong to make or break a connection between the upper tubular and the lower tubular.

According to the invention, the pinion and the guide wheel, for cooperating with the rack and guide track for transferring the torque, are both mounted on the drive shaft of the respective hydraulic drives, which hydraulic drives are positioned with their drive shaft parallel to the main axis and between the grippers. The rack and the guide track are adjacent to each other and extend parallel to each other.

Because the first hydraulic drive and the second hydraulic drive of the torque actuator are mounted between the grippers of the lower tong and the upper tong, the hydraulic drives extend in the potential trajectory of movement of the grippers being rotated. Even though the hydraulic drives thus restrict the movement of the tongs relative to each other, it has been found that this configuration allows for an effective and compact design of the power tongue.

Thus, the invention allows for mounting the hydraulic drives within an envelope defined by the grippers of the upper tong and lower tong, and thus for a compact and efficient power tong. It is noted that in the prior art the drives for providing the power tong with torque are typically mounted outside the envelope defined by the grippers, thus on top of the upper tong, below the lower tong, and/or on the, relative to the main axis, radial outside of the grippers. Thus prior art tongs are bulky in design.

In an embodiment, the guide track comprises a first track section for cooperating with the guide wheel of the first hydraulic drive and a second guide track for cooperating with the guide wheel of the second hydraulic drive, and preferably the rack comprises a first rack section for cooperating with the pinion of the first hydraulic drive and a second rack section for cooperating with the pinion of the second hydraulic drive.

In a further embodiment, the first hydraulic drive and the second hydraulic drive are located between the gripper actuators, such that the first track section and the second track section each extend between two gripper actuators. Positioning the guide track and preferably the rack between the grippers, allows for a power tong with a compact design.

In an embodiment, the guide track has an inside guide surface and an outside guide surface, the inside guide surface and the outside guide surface defining between them the guide track, the guide wheel preferably abutting both the inside and the outside guide surface. Thus, the guide wheel is locked between the two guide surfaces, and the freedom of movement is limited to movement along the guide track. This is in particular beneficial when large torque is to be generated, to prevent relative movement of the tongs, in particular sideways movement of the pinion relative to the rack, i.e. in a direction perpendicular to the main axis.

It is submitted that the lower tong and the upper tong are similar in set up. Typically, the lower tong and the upper tong comprise the same number of grippers. Also, the grippers of the upper tong are preferably positioned above the grippers of the lower tong, when the upper tong and the lower tong are positioned with their respective radial openings positioned above each other.

In a preferred embodiment, the hydraulic drives of the torque actuator are all mounted on the lower tong frame, and the guide track and rack are mounted on the upper tong frame. In an alternative preferred embodiment, the hydraulic drives of the torque actuator are all mounted on the upper tong frame, and the guide track and rack are mounted on the lower tong frame.

In yet another embodiment, one hydraulic drive is mounted on the lower tong frame while the other hydraulic drive is mounted on the upper tong frame. In such an embodiment, a first guide track section and a first rack section, for cooperating with the guide wheel and the pinion of the first hydraulic drive, are mounted on the upper tong frame, while a second guide track section and a second rack section, for cooperating with the guide wheel and the pinion of the second hydraulic drive, are mounted on the lower tong frame.

The support frame supports the lower tong and/or the upper tong with the upper tong being located above the lower tong, the tubular passage of the upper tong is aligned with the tubular passage of the lower tong.

In a preferred embodiment, the support frame is configured to be coupled with a support arm, for example a moveable support arm mounted on a track extending along a drilling tower, for example a multi purpose tower.

In addition, or as an alternative, the support frame is configured to be coupled with, or is part of, a cart or trolley that can be driven over a drill platform, to move the power tong into and out of position near a firing line of a drilling tower, for example a derrick or multi purpose tower.

Typically, the upper tong and the lower tong need to be supported such that the tubular passage of the upper tong is aligned with the tubular passage of the lower tong. It is noted that at least one tong should be moveably supported such that the tongs can rotate relative to each other. In an embodiment, the lower tong is fixed in positon, while the upper tong is moveable supported such that it can rotate relative to the lower tong.

In an embodiment, the support frame supports the lower tong in the fixed position and movably supports the upper tong, e.g. the lower tong frame is provided with one or more guides and/or supports for engaging the upper tong frame, such that the upper tong can be rotated relative to the lower tong.

In a preferred alternative embodiment, the lower tong is supported by the support frame, and the upper tong is supported by the lower tong, i.e. the lower tong frame is provided with a guide and/or supports for moveably supporting the upper tong.

In an embodiment, the power tong further comprises a spinner for gripping the upper tubular, which spinner is supported above the upper tong by the support frame. In such an embodiment, the spinner preferably is moveably supported such that it can move along the main axis to move with, and preferably guide, a upper tubular while its lower threaded end, or threaded pin, is spun into or is spun out off the upper threaded end, or threaded box, of the lower tubular.

In an embodiment, the lower tong frame and the upper tong frame comprise interacting positioning guides, for positioning the upper tong relative to the lower tong in at least a vertical direction and preferably for supporting the upper tong. It is noted that when the power tong is used, the threaded ends of the lower tubular and upper tubular are already in engagement, thus, when the grippers of the lower tong and the grippers of the upper tong engage the respective lower tubular and upper tubular, this also positions the upper tong relative to the lower tong.

The lower tong and the upper tong are each provided with multiple grippers, i.e. at least two grippers, preferably three grippers. The grippers have a linear working axis, said working axis extending perpendicular to the main axis, to engage a tubular supported in the tubular passage perpendicular to the circumferential surface of that tubular.

The grippers of a tong are arranged around the tubular passage for gripping a tubular in the tubular passage from different sides, and are configured to engage the tubulars with a force high enough to enable transferring the torque transfer required for torqueing up, or torqueing down the connection between the two tubulars.

The grippers can be cylinders, for example hydraulic or pneumatic cylinders. In an alternative embodiment, the grippers may be mechanical grippers, for example comprising a driven pinion engaging a rack, or may comprise an electric spindle.

In an embodiment, each gripper comprises a gripper actuator part and a gripper beak part. The gripper beak part is moveable supported in the actuator part. The actuator part is configured for moving the gripper beak part along a work axis. The work axis of the gripper extending in a radial direction, and preferably perpendicular to the main axis.

The rack and pinion comprises intermeshing teeth for transferring the torque generated by the hydraulic drive, i.e. to move the pinion along the rack and thus rotate one tong relative to the other. The pinion is provided with teeth around a peripheral surface thereof, while the rack comprises a row of teeth defining the trajectory of movement of the pinion. With a power tong according to the invention, the rack extends along a curved trajectory having a centre of curvature that coincides with the main axis of the power tong. Thus, the tong is rotated about the main axis.

In a preferred embodiment, the teeth of the rack face inwards, i.e. towards the main axis, and the pinion thus moves along an inward facing side of the rack. This allows for a compact design in combination with efficient torque transfer.

Typically, a spinner is used for coupling and decoupling a threaded connection between two tubulars. The lower tubular is supported in a position on the main axis by a tong while the upper tubular is positioned on the main axis, and aligned with the lower tubular, by the spinner. The spinner is configured for rotating a tubular with a high number of revolutions per time unit, but with low torque.

Once the lower tubular and the upper tubular are connected by spinning the threaded lower end of the upper tubular into the threaded upper end, also referred to as the threaded box, of the lower tubular, the power tong is used to torque up the connection. Typically, the power tong is configured to deliver high torque over a limited number of revolutions or even a limited angle of rotation.

Inversely, when disconnecting two tubulars, prior to the spinner being used for spinning the treaded end of the upper tubular out of the threaded box of the lower tubular, the power tong is used to torque down he connection.

It is submitted that when the grippers of the lower tong and the grippers of the upper tong engage a lower tubular and a upper tubular respectively, the relative position of the tongs is defined by the upper tubular and the lower tubular. Typically, the lower tubular is supported in slips provided in the drilling opening in the drilling deck, thus, the position of the lower tubular is fixed. The threaded coupling between the lower tubular and the upper tubular positions the upper tubular relative to the lower tubular.

Thus, when the lower tong grips the lower tubular and the upper tong grips the upper tubular, and torque is applied, and the upper tubular is pivoted relative to the lower tubular, the upper tong moves with the upper tubular. The function of the guide track and the rack is not to guide the tongs relative to each other, but to transfer the torque.

The tongs furthermore comprise a radial opening that provides a lateral access to the tubular passage, to bring tubulars in a radial direction into or out of the tubular passage, for example by the power tong respectively being moved towards or away from tubulars supported on the main axis.

The lower tong and upper tong can be positioned into an input-output position relative to each other. In the input-output position, the lower tong and the upper tong have an angular position relative to each other such that the radial openings, when seen in top view, are aligned. Thus, when the lower tong and the upper tong are in the input-output position, a tubular, or tubulars, can be moved via the radial opening of the lower tong and the radial opening of the upper tong towards and away from the main axis.

Furthermore, in a preferred embodiment, the lower tong and the upper tong each have an identical number of grippers, and the grippers in the upper tong are aligned with the grippers in the lower tong, when seen in a top view, when the lower and the upper tong are in the input-output position.

According to the claimed invention, the hydraulic drives are positioned with their drive axis parallel to the main axis. The drive shaft of the hydraulic drives supports the guide wheel and the pion, the guide wheel engaging a guide surface and the pinion engaging a rack. Due to the guide wheel and the pinion being mounted on the drive shaft, the guide track and the rack extend parallel to each other The hydraulic drives, including the pin and guide wheel, have a height similar too or larger than the height of the grippers, preferably larger than the height of grippers of the lower tong and the upper tong. Thus, the hydraulic drives, or at least a part of the hydraulic drive is located between the grippers of the lower tong and extends in a space between the grippers of the upper tong.

The guide track and the rack each extend along a curved trajectory, the curved trajectories each having the main axis as the centre of curvature, such that the guide track and the rack extend parallel to each other.

Preferably, the tong, preferably the lower tong, comprising the hydraulic drives remains in a fixed position when the hydraulic drives are actuated, and only the other tong, preferably the upper tong, is moved, more in particular is rotated about the main axis.

It is submitted that the grippers of a tong define a gripper envelop, i.e. a disc shaped space comprising the grippers. The gripper envelope has the main axis at its centre and a circumference defined by the gripper actuator. The hydraulic drives of the tongs are located within the outer circumference of the respective gripper envelopes.

In an embodiment, a significant part, preferably at least 25%, of each of the grippers is located outside the cylindrical space defined by the tubular support axle and the drive axis of the hydraulic drives.

In an embodiment the lower tong and the upper tong each comprise three grippers, which tubular grippers are located, at regular intervals, around the tubular passage of the lower tong and the upper tong respectively.

In an embodiment, a first plane comprising a drive axis of the first hydraulic drive and the main axis, and a plane comprising a drive axis of the second hydraulic drive and the main axis, extend relative to each other at an angle of 120 degrees.

In an embodiment, the lower tong and the upper tong each comprise three grippers, the grippers being positioned at regular intervals about the main axis, such that for each tong the work axis of the grippers extend perpendicular to the main axis and the work axis of two grippers extend at a relative angle of 120 degrees. Furthermore, the lower tong is provided with the first hydraulic drive and the second hydraulic drive, and the upper tong is provided with the guide track and the rack. The first hydraulic drive and the second hydraulic drive are mounted to the frame of the lower tong such that their respective drive shafts are directed upwards, and the guide wheel and the pinion mounted on the drive shaft engage the guide track and the rack respectively.

In a further preferred embodiment, the guide track and the rack comprise a first guide track section and a first rack section for cooperating with the guide wheel and the pinion of the first hydraulic drive and a second guide track section and a second rack section for cooperating with the guide wheel and the pinion of the second hydraulic drive.

Preferably, the first guide track section and the first rack section extend between a first and a second gripper, the second guide track and the second rack section extend between the second gripper and the third gripper, and the radial opening of both the lower yaw and the upper yaw is located between the third gripper and the first gripper.

In a preferred embodiment, for at least the first and at least the second hydraulic drive the guide wheel is located at the end of the drive shaft, and the pinion is located between the guide wheel and the housing of the hydraulic motor.

In an embodiment, the power tong further comprises a spinner for gripping the upper tubular, which spinner is supported above the upper tong by the support frame, preferably is moveably supported such that it can move along the main axis to move with, and preferably guide, a upper tubular while its lower threaded end, or threaded pin, is spun into or is spun out off the upper threaded end, or threaded box, of the lower tubular. Thus, the spinner can be used to make the connection between two tubulars, e.g. driving the threaded pin end of an upper tubular into the thread box end of a lower tubular. The power tong is subsequently used to torque up the connections between the tubulars.

In a further embodiment, the spinner comprises two spinner assemblies, each spinner assembly comprising a set of spinner rollers and at least one hydraulic drive for rotating the spinner rollers, which spinner rollers and at least one hydraulic drive are supported in a spinner rollers support frame, wherein the spinner assemblies are each moveably supported, preferably by a by a linear actuator, e.g. a hydraulic or pneumatic actuator, to enable moving the sets of spinner rollers towards and away from each other, and to clamp a tubular between the two sets of spinner rollers.

In a further embodiment, the spinner assemblies are each moveably supported by a linear actuator, e.g. a hydraulic or pneumatic actuator, which linear actuators are positioned opposite each other, such that working lines of the actuators can coincide, and wherein the actuators are pivotably mounted onto a spinner frame such that they can pivot about a pivot axis extending parallel to the main axis. The use of linear actuators allows for a direct control of the position at which the spinner assembly is located, and of the force with which the tubular is held between the spinner assemblies.

In an embodiment, the spinner frame is hingeable supported, such hat it can be pivoted, preferably about a pivot axis parallel to the main axis, between an active position in which the spinner rollers can engage a tubular located on the main axis, and an inactive position, in which the spinner rollers are away for the main axis. Thus, the spinner can be moved away from the main axis to enable an object, for example a flange of a tubular or a device mounted onto a tubular or between two tubulars, to be lowered along the main axis without engaging the spinner assemblies.

In an embodiment, the spinner comprises a guide mechanism comprising two L-shaped guide arms, which L-shaped guide arms are pivotably supported at their elbow section such that they can pivot about a guide arm pivot axis parallel to the main axis, which L-shaped guide arms each at one end each have a curved and teethed couple surface, the center of curvature of the couple surface coinciding with the guide arm pivot axis of the respective guide arm, and which guide arms engage each other with said couple surfaces, and which L-shaped guide arms are each at an opposite end slideable coupled with one of the spinner assemblies, e.g. comprise a slot that engages a notch provided on a spinner roller support frame.

this embodiment allows for an accurate guiding of the spinner assemblies, in particular because movement of one spinner assembly is directly coupled to movement of the second spinner assembly, and thus the positon of the first spinner assembly is directly coupled to the position of the second spinner assembly. The invention thus provides a spinner According to a second aspect, the invention provides a spinner as disclosed above, for use with a power tong, for example a power tong as disclosed above. Such a spinner at least comprises: a guide mechanism comprising two L-shaped guide arms, which L-shaped guide arms are pivotably supported at their elbow section such that they can pivot about a guide arm pivot axis parallel to the main axis, which L-shaped guide arms each at one end each have a curved and teethed couple surface, the center of curvature of the couple surface coinciding with the guide arm pivot axis of the respective guide arm, and which guide arms engage each other with said couple surfaces, and which L-shaped guide arms are each at an opposite end slideable coupled with one of the spinner assemblies, e.g. comprise a slot that engages a notch provided on a spinner roller support frame.

The invention furthermore provides a method to connect or disconnect two tubulars, more in particular to make-up or break out a tubular connection, using a power tong according to the invention, the method comprising:

receiving an upper tubular and a lower tubular, both supported in a firing line, in the upper tong and in the lower tong;

engaging the upper tubular with the upper tong and the lower tubular with the lower tong; and rotating the upper tong relative to the lower tong and about the main axis of the power tong, to connect or disconnect the upper tubular gripped by the upper tong and the lower tubular gripped by the lower tong.

The invention furthermore provides a method to connect two tubulars, more in particular to make-up a tubular connection, using a power tong according to the invention, the method comprising:

receiving a lower tubular, supported in a firing line, in the lower tong;

engaging the lower tubular with the lower tong;

receiving an upper tubular in a spinner located directly above the upper tong;

engaging the upper tubular with the spinner;

stabbing a lower threaded end, or pin end, of the upper tubular in an upper threaded end, or thread box end, of the lower tubular, and driving the threaded lower end of the upper tubular into the upper threaded end of the lower tubular, using the spinner to rotate the upper tubular relative to the lower tubular, engaging the upper tubular with the upper tong; and rotate the upper tong relative to the lower tong and about the main axis of the power tong, to connect the upper tubular gripped by the upper tong with the lower tubular gripped by the lower tong, more in particular to torque up the connection between the upper tubular and the lower tubular.

The invention furthermore provides a method to disconnect two tubulars, more in particular to break out a tubular connection, using a power tong according to the invention, the method comprising:

receiving a upper tubular, supported in a firing line, in the upper tong, and receiving a lower tubular, supported in a firing line, in the lower tong, the upper tubular being connected with a torqued up connection to the lower tubular;

engaging the upper tubular with the upper tong and the lower tubular with the lower tong; and rotate the upper tong relative to the lower tong and about the main axis of the power tong, to disconnect the upper tubular gripped by the upper tong from the lower tubular gripped by the lower tong, more in particular to torque down the connection between the upper tubular and the lower tubular.

A further method to disconnect two tubulars using a power tong according to the invention, comprises, after the connection between the upper tubular and the lower tubular has been torqued down:

engaging the upper tubular with a spinner, and releasing the upper tubular with the upper tong;

rotate the upper tubular relative to the lower tubular and about the main axis of the power tong, to disconnect the upper tubular gripped by the spinner from the lower tubular gripped by the lower tong, more in particular driving the threaded lower end of the upper tubular out of the upper threaded end of the lower tubular, using the spinner to rotate the upper tubular relative to the lower tubular.

According to a third aspect, the invention provides for a power tong, preferably a power tong according to the first aspect or according to the second aspect of the invention, comprising a hydraulic drive and, in addition to the hydraulic drive, a booster pack.

The hydraulic drive comprises a hydraulic power source to generate hydraulic power for driving the power tong, more in particular the spinner and tongs, e.g. the grippers and the relative movement of the tongs. The power source of the hydraulic drive may be located offside, i.e. not on the power tong.

The booster back comprises a hydraulic buffer. The hydraulic buffer preferably is loaded with hydraulic power accumulated from the power source of the hydraulic drive. The purpose of the booster is to provide a short burst of high hydraulic power to drive the relative movement of the tongs to torque up a connection between two tubulars.

Preferably the booster pack is located on side, i.e. close to the power tong, preferably is supported by the support frame of the power tong, while the hydraulic drive may is located offside, i.e. not on the power tong.

The third aspect allows for a power tong comprising a comparatively low pressure hydraulic power source for driving the power tong, and a comparatively high pressure high pressure hydraulic power source in the form of the booster pack to drive the tongs to torque up a connection. It was realised that the booster pack can be loaded over a relatively long time, i.e. between torque up actions, and only needs to be utilized for short periods of time. Thus low pressure can be accumulated into high pressure at a steady pace, to enable a short burst of high hydraulic energy when needed.

Thus the power tong can be provided with a low hydraulic power system for the more common actions, and a compact high power network for driving the power tongs. Due to providing the booster pack, the hydraulic power source of the hydraulic drive does not need to be configured to provide the high pressures required by the power tong to torque up or torque down a tubular connection. It is sufficient for it to provide the booster pack with comparatively low hydraulic power.

Advantageous embodiments of the power tong according to the invention and the method according to the invention are disclosed in the sub claims and in the description, in which the invention is further illustrated and elucidated on the basis of a number of exemplary embodiments, of which some are shown in the schematic drawing. In the figures, components corresponding in terms or construction and/or function are provided with the same last two digits of the reference numbers.

BRIEF DESCRIPTION OF THE DRAWINGS

In the figures:

FIG. 11 shows a top view of the upper tong in partial see through;

FIG. 1 shows a perspective view of a power tong 1 according to the claimed invention. The power tong comprises an upper tong 2 and a lower tong 3.

Figure 1:
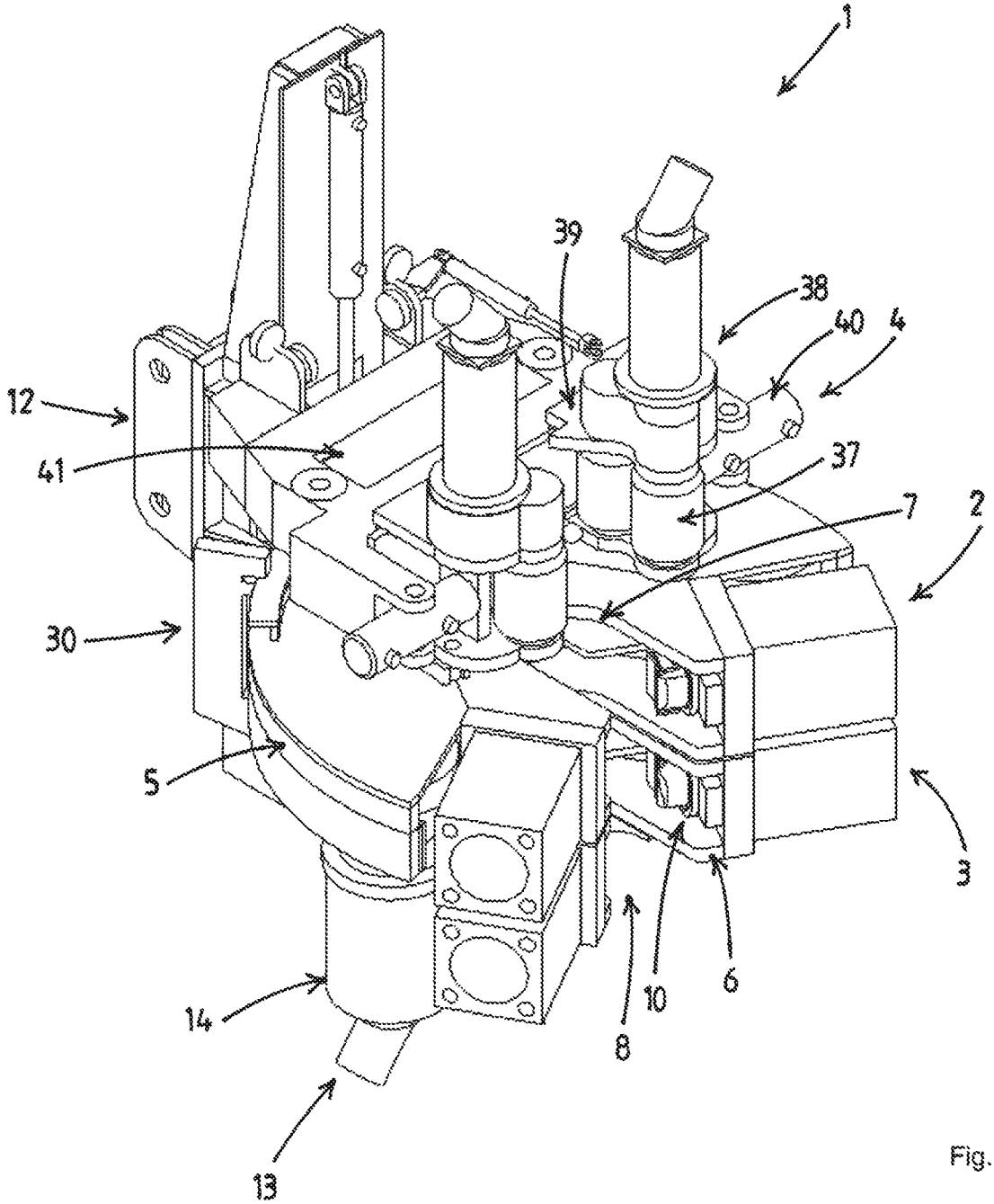
FIG. 1 shows a perspective view of an power tong, which power tong is provided with a spinner.

The power tong 1 is configured for applying torque to a lower tubular 24 relative to a upper tubular 23, to thus connect and disconnect an upper threaded end of the lower tubular 24 and a lower threaded end of the upper tubular 23, more in particular to torque up and torque down a connection between the upper tubular and the lower tubular, the lower tubular 24 and upper tubular 23 being coaxially supported on a main axis 9 of the power tong 1.

In the exemplary embodiment shown, the power tong 1 is provided with a spinner 4.

Figure 2:
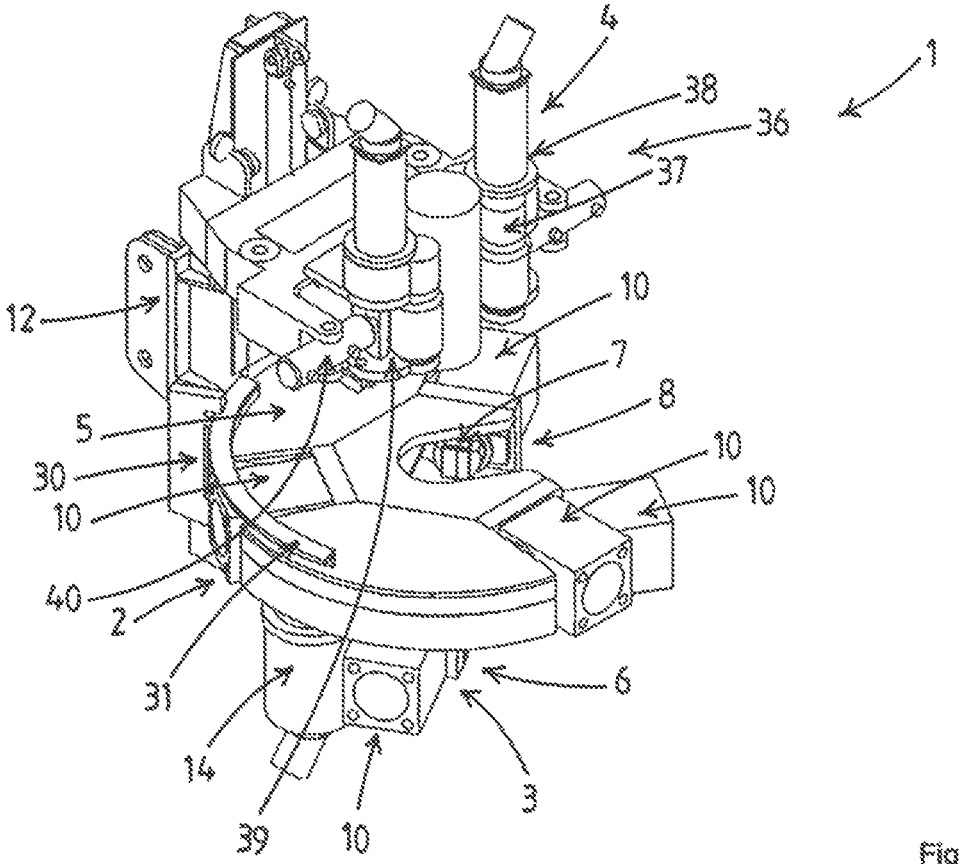
FIG. 2 shows a perspective view of the power tong of FIG. 1 with the spinner in an active position.
Figure 3:
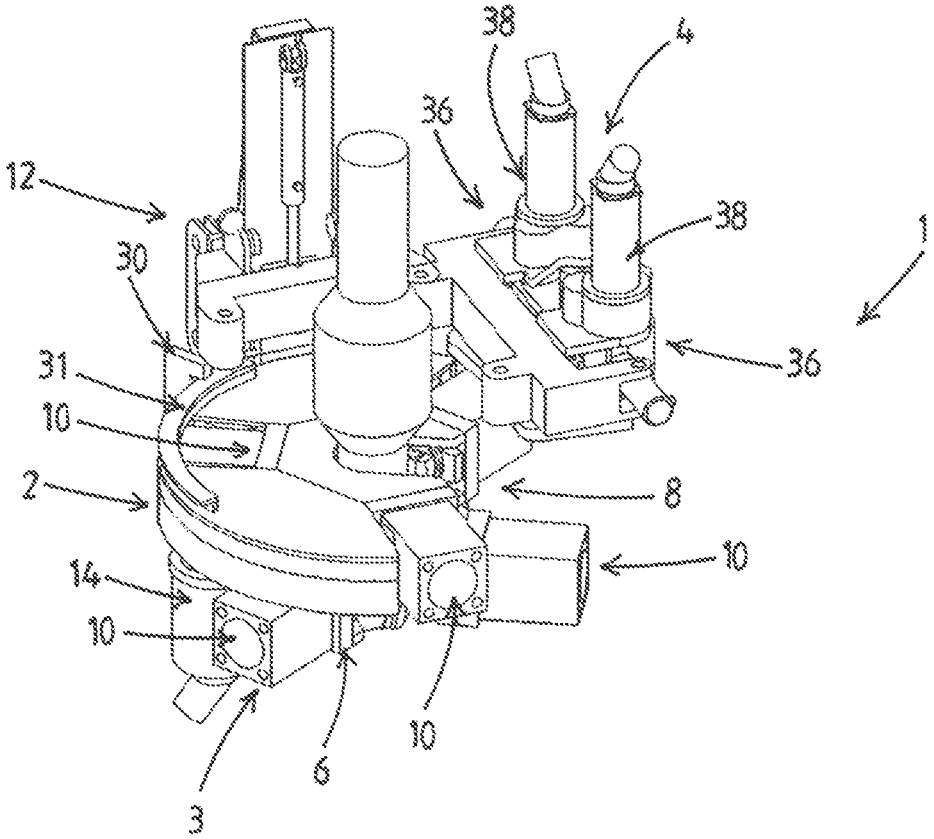
FIG. 3 shows a perspective view of the power tong of FIG. 1 with the spinner in an inactive positon.

FIG. 2 shows a perspective view of the power tong 1 with the spinner 4 in an active position, and FIG. 3 shows a perspective view of the power tong of FIG. 1 with the spinner 4 in an inactive positon.

Figure 4:
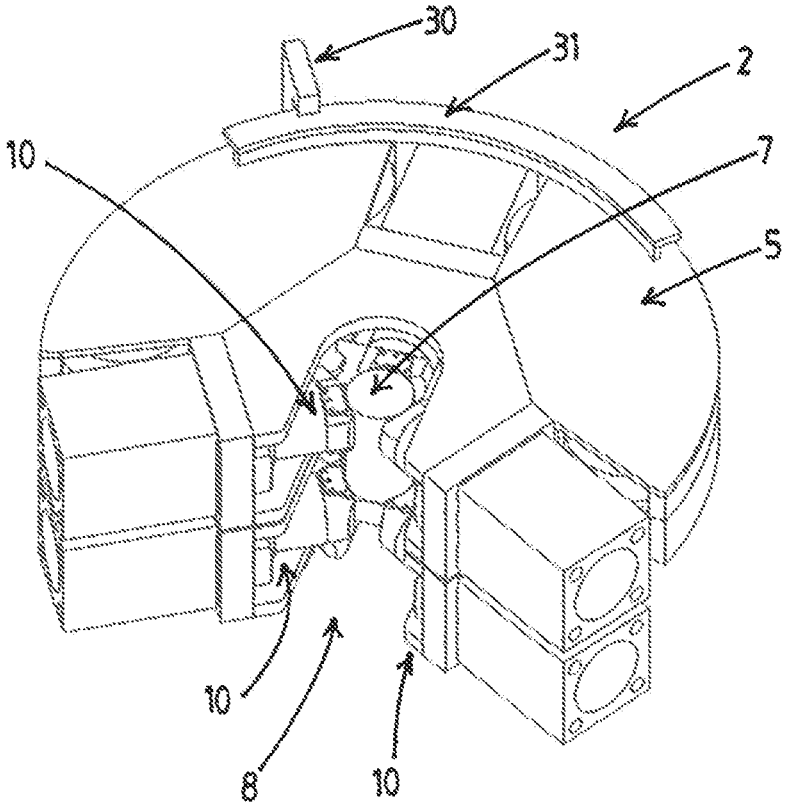
FIG. 4 shows a perspective view of an upper tong and a lower tong of the power tong of FIG. 1 in isolation.
Figure 5:
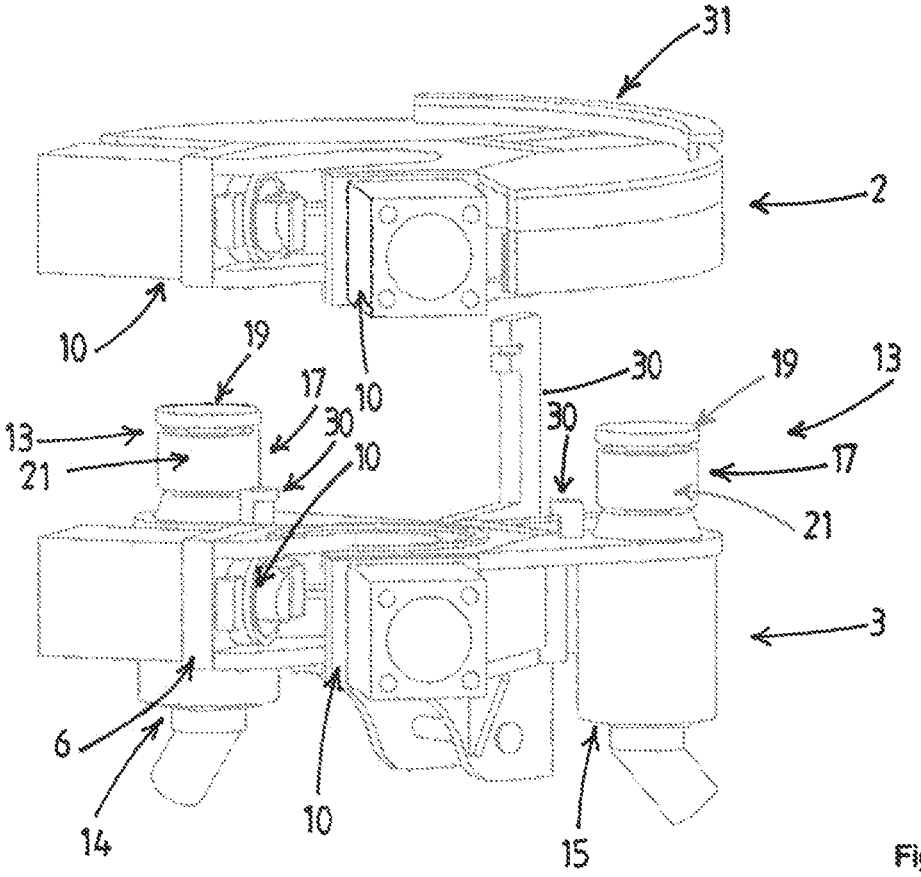
FIG. 5 shows a perspective side view of the upper tong and the lower tong of the power tong of FIG. 1 in isolation and separated from each other.
Figure 6:
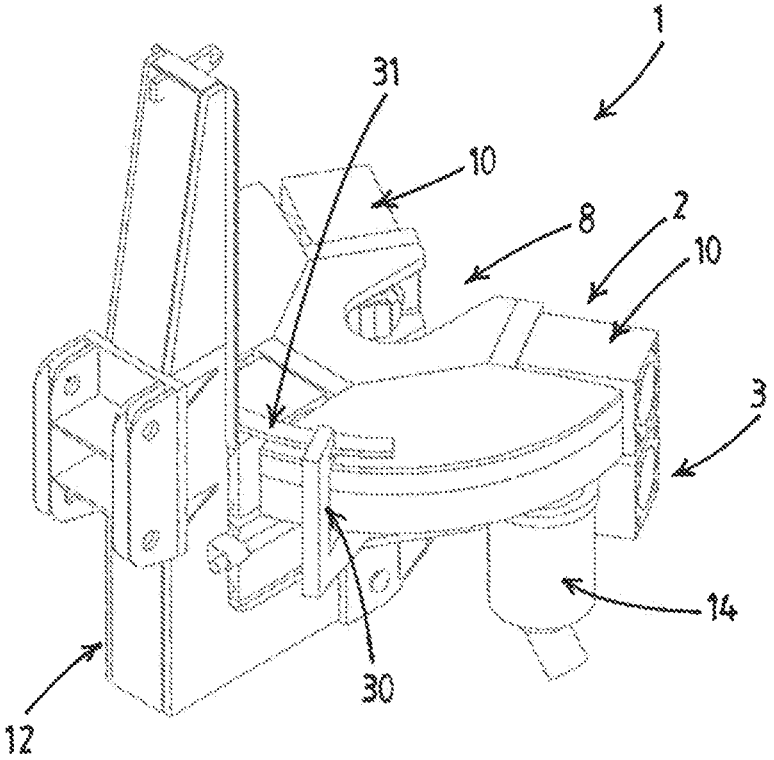
FIG. 6 shows a perspective view of the upper tong and the lower tong and a support frame of the power tong of FIG. 1 in isolation.
Figure 7:
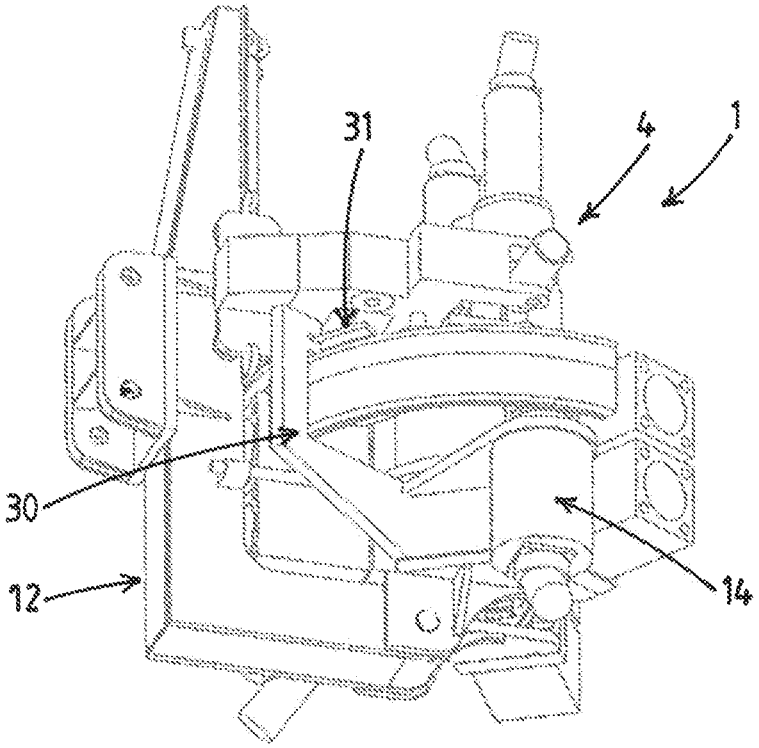
FIG. 7 shows a perspective bottom view of the upper tong and the lower tong and the support frame of the power tong of FIG. 1 in isolation.

FIG. 4 shows a perspective view of the power tong 1 in isolation, while FIG. 5 shows the power tong 1 in isolation with the upper tong 2 and the lower tong 3 separated from each other.

The upper tong 2 and the lower tong each comprise a frame, an upper tong frame 5 and a lower tong frame 6 respectively, the frames each defining a central tubular passage 7. The upper tong 2 and the lower tong 3 each have a radial opening 8 that provides lateral access to the tubular passage 7. Thus, via the radial opening 8 a tubular can be introduced in the tubular passage 7, or be removed from the tubular passage 7, by moving the power tong 1 and the tubular relative to each other in a direction perpendicular to a main axis 9 of the power tong, which main axis extends through the tubular passage 7 of the upper tong 2 and the tubular passage 7 of the lower tong 3.

It is noted that when the power tong 1 is used for connecting or disconnecting tubulars, the main axis 9 of the power tong 1 typically coincides with a firing line of tubular supporting device, for example a multi-purpose tower, a rick, etc.

Both the upper tong 2 and the lower tong 3 comprise multiple grippers 10, which grippers are distributed around the tubular passage 7 for gripping a tubular in the tubular passage.

Each gripper 10 has a linear working axis 11 that extends perpendicular to a main axis 9 of the power tong 1. The main axis 9 runs central to the tubular passages 7 of the upper tong 2 and the lower tong 3.

The power tong 1 furthermore comprises a support frame 12 supporting the lower tong 3. In the embodiment shown, the upper tong 2 is mounted onto the lower tong 3. Both the upper tong 2 and the lower tong 3 are supported with the respective tubular passages aligned on the main axis of the power tong.

The power tong 1 furthermore comprises a torque actuator 13. The torque actuator comprises a first hydraulic drive 14 and a second hydraulic drive 15, for rotating the upper tong 2 relative to the lower tong 3 and about the main axis 9 of the power tong, to connect or disconnect a lower tubular gripped by the lower tong and the upper tubular gripped by the upper tong.

Figure 8:
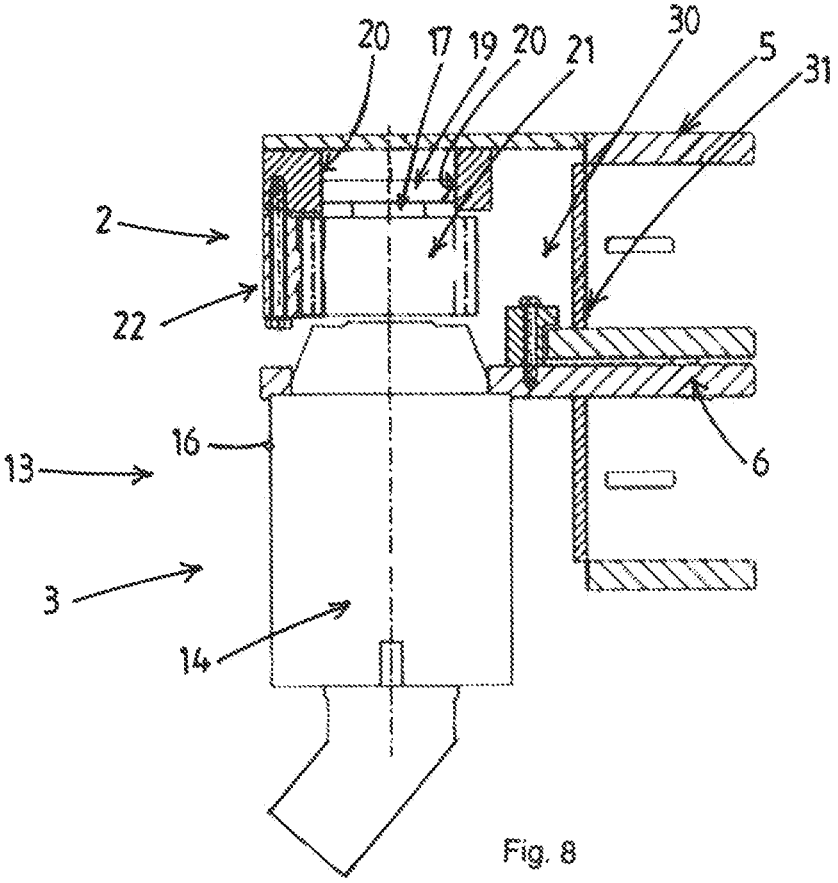
FIG. 8 shows a cross sectional side view of a hydraulic drive of the power tong of FIG. 1.
Figure 9:
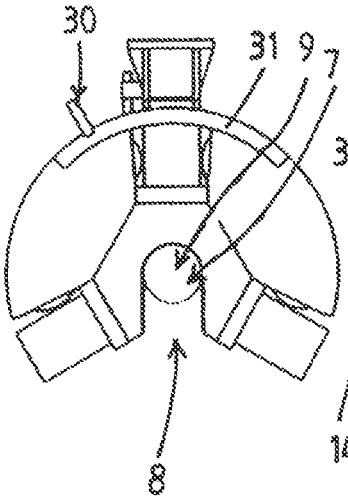
FIG. 9 shows a top view of the lower tong of the power tong of FIG. 1.
Figure 10:
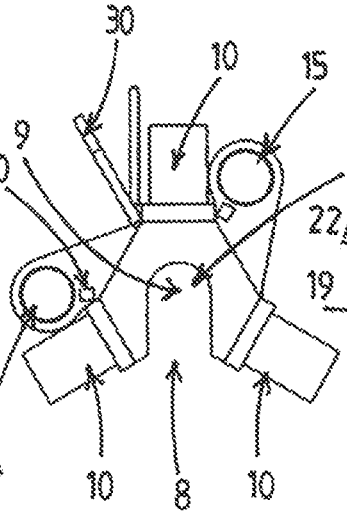
FIG. 10 shows a top view of part of the lower tong of the power tong of FIG. 1.
Figure 11:
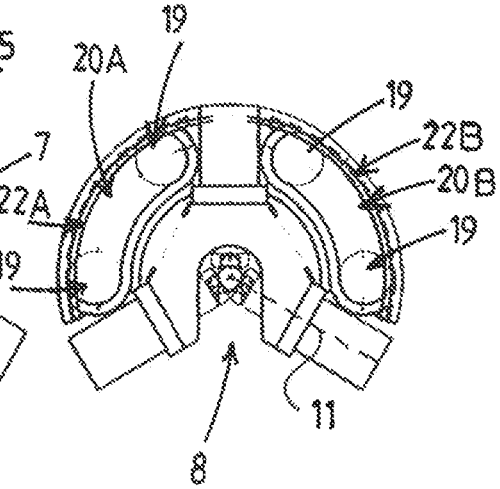
Figure 12:
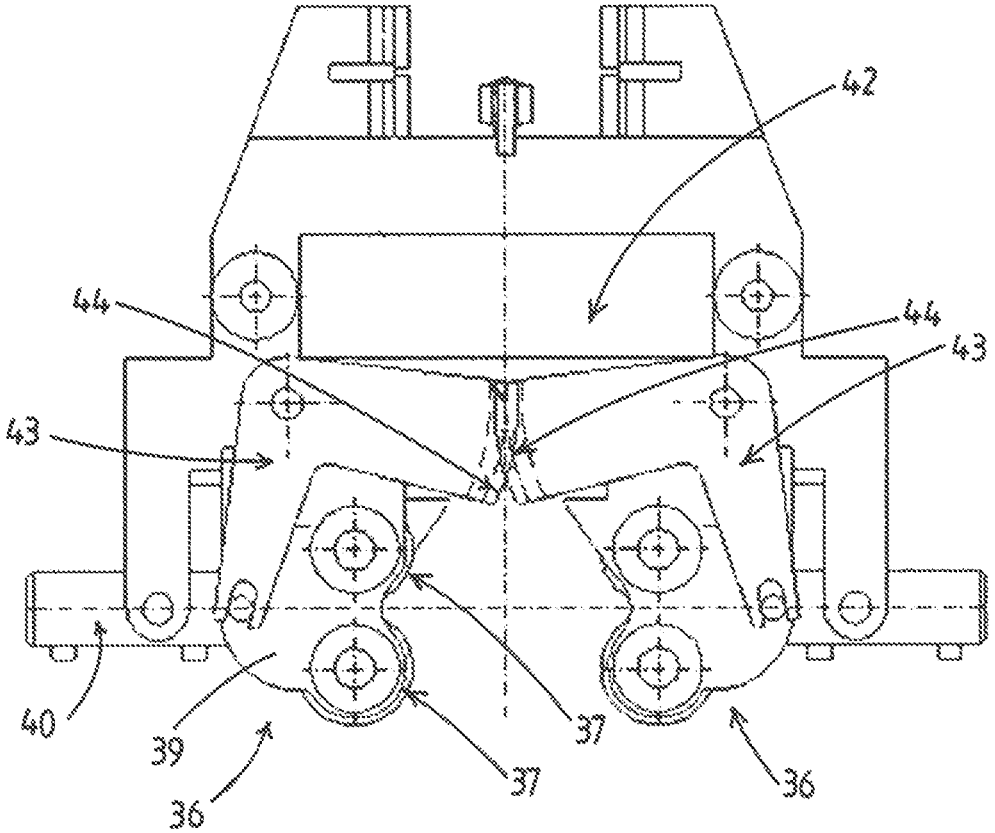
FIG. 12 shows a top view of the spinner of the power tong of FIG. 1 in isolation, wherein the spinner is in a receiving position.
Figure 13:
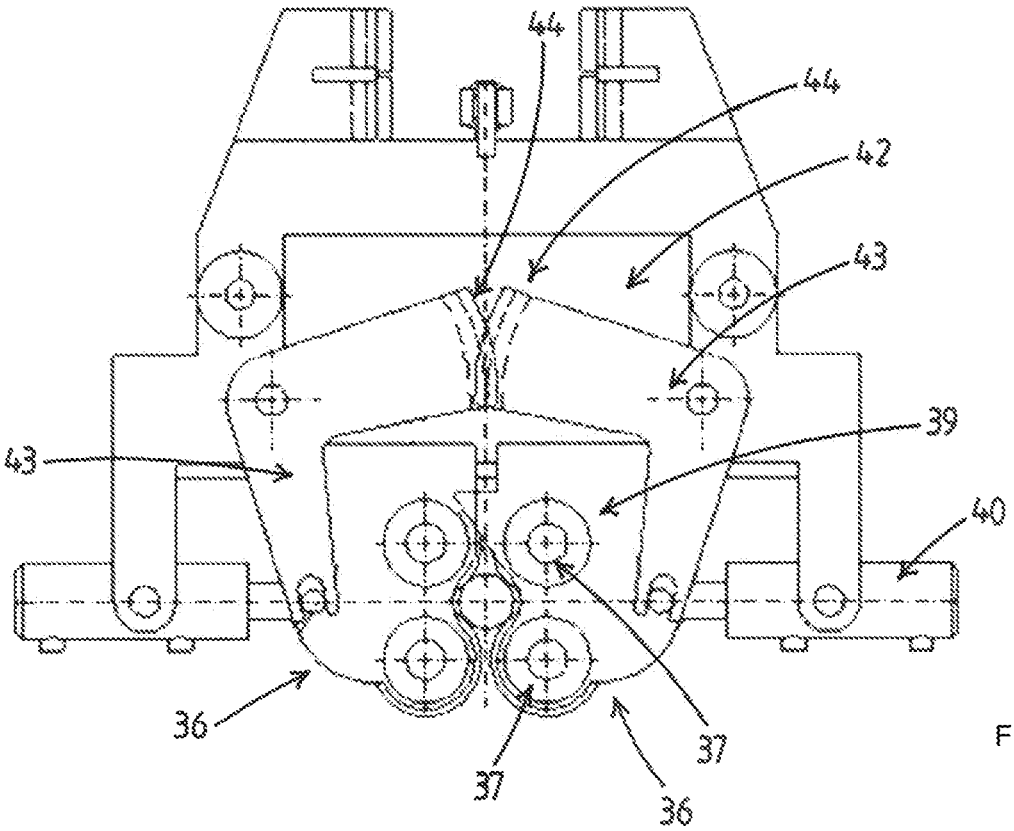
FIG. 13 shows a top view of the spinner of the power tong of FIG. 1 in isolation, wherein the spinner is in a spinning position.

The torque actuator 13 is shown in more detail in FIGS. 8, 9, 10 and 12. FIG. 8 shows a cross sectional side view of the first hydraulic drive 14 of the power tong 1. FIG. 9 shows a top view of the lower tong 3. FIG. 10 shows a partial view of the lower tong 3, and FIG. 11 shows the upper tong in partial see through.

The first hydraulic drive 14 and the second hydraulic drive 15 each have a housing 16 and a drive shaft 17 extending from that housing. Each drive shaft 18 supports a guide wheel 19 for cooperating with a guide track 20 and comprises a pinion 21 for cooperating with a rack 22, which guide wheel 19 and pinion 21 are concentrically mounted on the drive shaft 18 of the hydraulic drive.

In the embodiment shown, the first hydraulic drive 14 and the second hydraulic drive 15 are mounted on the lower tong frame 6 of the lower tong, each with the drive shaft 17 parallel to the main axis 9 of the power tong. The upper tong 3 comprises the guide track 20 receiving the guide wheel 19. The upper tong 3 furthermore comprises the rack 22 for cooperating with the pinion 21 of the first hydraulic drive and the second hydraulic drive. The torque actuator 13 thus enables the hydraulic drives 14, 15 to rotate and guide the upper tong 2 relative to the lower tong 3.

In an alternative embodiment, the first hydraulic drive 14 and the second hydraulic drive 15 are mounted on the upper tong frame 8, each with the drive shaft 17 parallel to the main axis 9, and the lower tong 2 comprises the guide track receiving the guide wheel and the rack cooperating with the pinion of the first hydraulic drive and the second hydraulic drive, to enable the hydraulic drives to rotate and guide the upper tong relative to the lower tong.

The power tong 1 comprises the lower tong 3 for gripping the lower tubular 24 and the upper tong 2 for gripping the upper tubular 23, and is provided with a torque actuator 13, comprising a rack and pinion drive and a guide track, for rotating the upper tong relative to the lower tong.

The power tong 1 is thus adapted to apply torque to the lower tubular 24 relative to a upper tubular 23, the lower tubular and upper tubular being supported on the main axis 9 of the power tong, to thus connect and disconnect an upper threaded end 27 of the lower tubular and a lower threaded end 26 of the upper tubular.

More in particular, the spinner 4 is used to make the connection between two tubulars by driving the threaded pin end of an upper tubular 23 into the thread box end of a lower tubular 24. The power tong 1 is subsequently used to torque up the connection between the tubulars.

When disconnecting one tubular from the other, first the power tong is used to torque down the connection between the tubulars. Subsequently, the spinner is used to break the connection between two tubulars by spinning the upper tubular to drive the threaded pin end of the upper tubular out off the thread box end of a lower tubular.

When connecting one tubular with the other, first the spinner is used to make the connection between the two tubulars by spinning the upper tubular to drive the threaded pin end of the upper tubular into the thread box end of a lower tubular. Subsequently, the power tong is used to torque up the connection between the tubulars.

According to the invention, the pinion 21 and the guide wheel 19, for cooperating with the rack 22 and guide track 20 for transferring the torque, are both mounted on the drive shaft 17 of the respective hydraulic drives 14,15, which hydraulic drives are positioned with their drive shaft parallel to the main axis 9. In addition, the hydraulic drives 14,15 are positioned between the grippers 10, in other words, the hydraulic drives 14, 15 are each mounted on one of the respective tongs 2,3 and are located between the grippers 10 that are also mounted on the tongs 2,3.

In the embodiment shown, the rack 22 and pinion 21 comprise intermeshing teeth for transferring the torque generated by the hydraulic drives, i.e. to move the pinion 21 along the rack 22 and thus rotate the upper tong 2 relative to the lower tong 3. The pinion 21 is provided with teeth around a peripheral surface thereof, while the rack 22 comprises a row of teeth defining the trajectory of movement of the pinion. With a power tong according to the invention, the rack 22 extends along a curved trajectory having a centre of curvature that coincides with the main axis 9 of the power tong, more in particular the main axis of the tubular passage.

In the particular embodiment shown, the teeth of the rack 22 face inwards, i.e. towards the main axis 9, and the pinion 21 thus moves along an inward facing side of the rack 22. This allows for a compact design in combination with efficient torque transfer.

The rack 22 and the guide track 20 are adjacent to each other and extend parallel to each other. It is noted that a hydraulic drive mounted on the lower tong is to cooperated with a rack and guide track mounted on the upper tong, and vice versa. Furthermore, because the hydraulic drives are located between the grippers, a plane defined by the guide track intersects with the grippers. In an embodiment, 25% or more of the gripper, in its retracted condition, is located outside the plane defined by the guide track. In a further embodiment 40% or more of the gripper, in its retracted condition, is located outside the plane defined by the guide track.

Because the first hydraulic drive 14 and the second hydraulic drive 15 of the torque actuator 1 are mounted between the grippers 10 of the lower tong 3 and the upper tong 2, the hydraulic drives extend in the potential trajectory of movement of the grippers when the tongs 2,3 are rotated relative to each other. Even though the hydraulic drives 14,15 thus restrict the movement of the tongs 2,3 relative to each other, it has been found that this configuration allows for an effective and compact design of the power tongue 1.

Thus, the invention allows for mounting the hydraulic drives within an envelope defined by the grippers of the upper tong and lower tong, and thus for a compact and efficient power tong. It is noted that in the prior art the drives for providing the power tong with torque are typically mounted outside the envelope defined by the grippers, thus on top of the upper tong, below the lower tong, and/or on the, relative to the main axis, radial outside of the grippers. Thus prior art tongs are bulky in design.

In the embodiment shown, the guide track 20 comprises a first track section 20*a* for cooperating with the guide wheel 19 of the first hydraulic drive 14 and a second guide track 20*b* for cooperating with the guide wheel 19 of the second hydraulic drive 15.

In a further embodiment, the first hydraulic drive and the second hydraulic drive are located between the grippers, and the first track section and the second track section each extend between two grippers. Positioning the guide track and preferably the rack between the grippers as well, allows for a power tong with a more compact design.

In the embodiment shown, the guide track 20 has an inside guide surface 28 and an outside guide surface 29, the inside guide surface and the outside guide surface defining between them the guide track. The guide wheel 19 abuts both the inside guide surface and the outside guide surface, such that the guide wheel is locked between the two guide surfaces, and the freedom of movement is limited to movement along the guide track. This is in particular beneficial when large torque is to be generated, to prevent relative movement of the tongs, in particular sideways movement of the pinion relative to the rack, i.e. in a direction perpendicular to the main axis.

Furthermore, in the embodiment shown, the rack 22 comprises a first rack section 22*a* for cooperating with the pinion 21 of the first hydraulic drive 14 and a second rack section 22*b* for cooperating with the pinion 21 of the second hydraulic drive 22*b*.

It is submitted that the lower tong 3 and the upper tong 2 are similar in set up. Typically, the lower tong 3 and the upper tong 2 comprise the same number of grippers 10. Also, the grippers 10 of the upper tong 2 are positioned above the grippers 10 of the lower tong 3, when the upper tong 2 and the lower tong 3 are positioned with their respective radial openings 5 positioned above each other.

Also, in the preferred embodiment shown, the hydraulic drives 14,15 of the torque actuator 13 are all mounted on the lower tong frame 6, and the guide track 20 and rack 22 are mounted on the upper tong frame 5. It is noted that in the embodiment shown, the power tong 1 is configured for the hydraulic drives 14,15 to rotate the upper tong 2 relative to the lower tong 3. Thus, the hydraulic drives are mounted on the stationary power tong, which facilitates connecting the hydraulic drives with a hydraulic power source, e.g. a hydraulic power source mounted on the power tong.

Typically, the upper tong 2 and the lower tong 3 need to be supported such that the tubular passage 7 of the upper tong is aligned with the tubular passage of the lower tong. It is noted that at least one tong should be moveably supported such that the tongs can rotate relative to each other. In the embodiment shown, the lower tong is fixed in positon, while the upper tong is moveable supported such that it can rotate relative to the lower tong.

In use, the lower tong will engage the lower tubular, which often is part of a string of tubulars, which string of tubulars is for example supported by slips mounted in the working deck. The string, and thus the lower tubular, is support such that it can not be rotated about its longitudinal axis. For connecting an upper tubular to the lower tubular, or for disconnecting an upper tubular from the lower tubular, that upper tubular should be rotated relative to the fixed lower tubular. Thus, the upper tong, gripping the upper tubular, should be rotated relative to the lower tong. It is noted that the power tong can be configured such that part of the power tong, for example part of the support frame, rotates with the upper tong, relative to the lower tong. In another embodiment, the power tong is configured such that of the power tong only the upper tong rotates relative to the lower tong.

The power tong support frame 12 supports the lower tong 3 and the upper tong 2, with the upper tong being located above the lower tong such that the tubular passage 7 of the upper tong is aligned with the tubular passage of the lower tong.

Furthermore, in a preferred embodiment shown, the support frame 12 is configured to be coupled with a support arm, for example a moveable support arm mounted on a track extending along a drilling tower, for example a telescopic support arm mounted on a vertical track along a firing line of a multi purpose tower. the power tong is configured such that only the upper tong rotates relative to the lower tong.

In addition, the support frame 12 is configured to be coupled with a cart or trolley that can be driven over a working platform, e.g. a drilling deck of an offshore vessel, to move the power tong into and out of position near a firing line of a drilling tower, for example a derrick or multi purpose tower. The tubulars to be handled by the power tong are supported on the firing line. To enable the lower tong and the upper tong to respectively engage the lower tubular and the upper tubular, the tubulars should be located in the tubular passage of the power tong. Thus, the power tong is to be positioned with firing line passing through the tubular passage.

In the particular embodiment shown, the power tong support frame 12 supports the lower tong 3. The lower tong frame 6 is provided with positioning guides 30 interacting with positioning guides 31 of the upper tong frame 5, such that the upper tong is positioned in the vertical direction relative to the lower tong and can be rotated relative to the lower tong, see FIG. 4 and FIG. 5. Thus, the interacting positioning guides 30,31 position the upper tong 2 relative to the lower tong 3 in a vertical direction and in the horizontal plane.

The lower tong 3 and the upper tong 2 are each provided with multiple grippers, in the particular embodiment shown three grippers 10. The grippers 10 have a linear working axis 11, the working axis extending perpendicular to the main axis 9, to engage a tubular supported in the tubular passage perpendicular to a circumferential surface of that tubular.

The grippers 10 of each tong 2,3 are arranged around the tubular passage 7 for gripping a tubular in the tubular passage from different sides. The grippers 10 are furthermore configured to engage the tubulars with a force high enough to enable transferring the torque transfer required for torqueing up, or torqueing down, the connection between the two tubulars.

In the embodiment shown, the grippers 10 are embodied as cylinders, more in particular hydraulic cylinders. In an alternative embodiment, the grippers may be mechanical grippers, for example comprising a driven pinion engaging a rack, or may comprise an electric spindle.

The cylinders comprises a gripper actuator part 32, comprising the cylinder body, and a gripper beak part 33, comprising a piston 34 and a pad 35. The gripper beak part 33 is moveable supported in the actuator part 32. The actuator part is configured for moving the gripper beak part along the work axis 11. The work axis 11 of the gripper 10 extends in a radial direction, and perpendicular, to the main axis 9 of the power tong 1.

It is noted that when the upper tong and the lower tong are rotated relative to each other, they engage a threaded end of respectively the upper tubular and the lower tubular. The lower tubular is typically fixed in position, e.g. is held by slips in a drill floor or working deck. Furthermore, the power tong is used when the lower threaded end of the upper tubular is in engagement with the upper threaded end of the lower tubular. Thus, the lower tubular also positions the upper tubular. Both located in the tubular passage of the power tong to enable the lower tong and the upper tong to respectively engage the lower tubular and the upper tubular.

In the embodiment shown, the power tong is provided with a spinner. The spinner is mounted on top of the power tong, and is aligned with the central axis of the power tong such that when the power tong engages the tubulars supported in the firing line, the upper tubular, more in particular the lower end of the upper tubular, is received in the spinner.

The spinner 4 is used for coupling and decoupling a threaded connection between two tubulars supported in the tubular passage. The spinner 4 is configured for rotating the upper tubular 23 with a high number of revolutions per time unit, but with low torque. As such the spinner 4 is used for driving the threaded lower end of the upper tubular 23 into the threaded upper end of the lower tubular 24, after which the power tong 1 is used to torque up the connection, and vice versa.

In use the power tong 1 is supported by a support arm, for example a moveable support arm mounted on a track extending along a drilling tower, a cart, for example a skid cart. The power tong will be supported such that it can be moved in a horizontal direction for engaging and disengaging tubulars supported in a firing line. For example, the support arm may be a telescopic support arm configured to telescopically extend in a horizontal direction, or the skid cart is provided with a hingeable frame that moveably sports the power tong.

Thus, the power tong will be set up adjacent the firing line. For example, when an upper tubular is supported in the firing line, for example by a hoisting device or under a top drive, that has to be connected to a lower tubular supported in slips in the drilling deck, The lower tubular 24 is to be positioned on the main axis 9 of the power tong 1 by the lower tong gripping the lower tubular. More in particular, the power tong 1 is to be positioned relative to the lower tubular 24, which is supported in a fixed position.

Therefore, the power tong is moved towards the firing line with the radial openings of the tongs aligned. Thus, the power tong can engage the tubulars supported in the firing line, and receive the tubulars in the tubular passage of the power tong.

The lower tong 3 and upper tong 2 are positioned into an input-output position relative to each other, see for example FIG. 1. In the input-output position, the lower tong 3 and the upper tong 2 have an angular position relative to each other such that the radial openings 8, when seen in top view, are aligned. Thus, when the lower tong and the upper tong are in the input-output position, a tubular, or tubulars, can be moved via the radial opening of the lower tong and the radial opening of the upper tong towards and away from the main axis.

Once the tubulars have thus been received in the tubular passage, the power tong, more in particular the lower tong is more exactly positioned by gripping the lower tubular, which is fixed in position relative to the drilling deck. By gripping the upper end of the lower tubular, the lower tong, and thus the upper tong supported by the lower tong, is positioned relative to the lower tubular.

It is noted that when an upper tubular 23 is to be connected with a lower tubular 24, the upper tubular is typically supported at its upper end, its lower end hanging free. In the embodiment shown, the spinner 4 can be opened wide to receive an upper tubular 23, more in particular the lower end of an upper tubular, that is not exactly aligned with the lower tubular 24, more in particular the upper end of the lower tubular. Subsequently closing of the spinner 4 aligns the lower end of the upper tubular 23 with the upper end of the lower tubular 24 held in the lower tong 3.

The upper tubular is subsequently lowered, and is guide by the spinner with its lower threaded end, or pin end, into the upper threaded end, or box end, of the lower tubular. The spinner rotates the upper tubular to make the threaded connection between the upper tubular and the lower tubular.

Once the lower tubular and the upper tubular are connected by spinning the threaded lower end of the upper tubular into the threaded upper end of the lower tubular, the upper tong grips the lower end of the upper tubular, to enable the power tong to torque up the connection.

The torque actuator 13, comprising the first hydraulic drive 14 and the second hydraulic drive 15, is used for rotating the upper tong 2 relative to the lower tong 3 and about the main axis 9, to torque up the connection.

In the embodiment shown, the upper tong is an active (or wrenching) tong, i.e. the tong that supplies torque to the section of pipe above the threaded connection, while the lower tong is a passive (or back up) tong that supplies a reaction torque below the threaded connection. The back up tong clamps the pipe below the threaded connection, and prevents it from rotating.

In the embodiment shown, the lower tong and the upper tong each comprise three grippers. The grippers are positioned at regular intervals about the main axis, such that for each tong the work axis of the grippers extend perpendicular to the main axis and the work axis of two grippers extend at a relative angle of 120 degrees.

Furthermore, the lower tong is provided with both the first hydraulic drive and the second hydraulic drive, and the upper tong is provided with the guide track and the rack. The first hydraulic drive and the second hydraulic drive are mounted to the frame of the lower tong such that their respective drive shafts are directed upwards, and the guide wheel and the pinion mounted on the drive shaft engage the guide track and the rack respectively.

Furthermore, the guide track and the rack comprise a first guide track section and a first rack section for cooperating with the guide wheel and the pinion of the first hydraulic drive and a second guide track section and a second rack section for cooperating with the guide wheel and the pinion of the second hydraulic drive.

The first guide track section and the first rack section extend between a first and a second gripper, the second guide track and the second rack section extend between the second gripper and the third gripper, and the radial opening of both the lower yaw and the upper yaw is located between the third gripper and the first gripper.

The guide wheel is located at the end of the drive shaft, and the pinion is located between the guide wheel and the housing of the hydraulic motor.

The guide track and the rack each extend along a curved trajectory, the curved trajectories each having the main axis as the centre of curvature, such that the guide track and the rack extend parallel to each other, see FIG. 11.

The hydraulic drives, including the pin and guide wheel, have a height larger than the height of the grippers of the lower tong and the upper tong, see FIG. 5. Thus, the hydraulic drives are located between the grippers of the lower tong and extends in a space between the grippers of the upper tong.

In the embodiment shown, the spinner 4 is used to make the connection between two tubulars, e.g. driving the threaded pin end of an upper tubular into the thread box end of a lower tubular. The power tong is, more in particular, the upper tong and the lower tong are, subsequently used to torque up the connection between the tubulars, and vice versa.

In the embodiment shown, the spinner 4 comprises a spinner frame 41. The spinner frame 41 is moveably supported by the power tong support frame 12, such that the spinner can be moved along the main axis 9 of the power tong 1.

Thus, the spinner 4 can engage the lower end of an upper tubular and move with that end, more in particular guide that end, while it is lowered into the upper end of the lower tubular held by the lower tong. Furthermore, the spinner can thus be lowered with the upper tubular while its threaded end is spun into the threaded end of the lower tubular.

In this context it is noted that the vertical displacement of the upper tubular relative to the lower tubular during the spinning action is significant. The spinner engages the upper tubular such that the tubular can not be moved relative to the spinner in a vertical direction. Therefore, the spinner is lowered with the tubular during the spinning action.

It is furthermore noted that a torque up or a torque down of a connection between two tubulars only causes a minimal vertical displacement of the upper tubular relative to the lower tubular. Therefore, the upper tong does not have to be moved in the vertical direction relative to the lower tong, and relative the lower tubular gripped by the lower tong, during the torque action.

In the preferred embodiment shown, the spinner 4 comprises two spinner assemblies 36. Each spinner assembly 36 comprises a set of spinner rollers 37 and one hydraulic drive 38 for rotating the spinner rollers. The spinner rollers 37 and a hydraulic drive 38 are supported in a spinner rollers support frame 39, wherein the spinner assemblies are each moveably supported, by a by a linear actuator in the form of a hydraulic actuator 40, to enable moving the sets of spinner rollers towards and away from each other, and to clamp a tubular between the two sets of spinner rollers.

The spinner assemblies 38 are each moveably supported by a linear actuator 40. The linear actuators 40 are positioned opposite each other, such that working lines of the actuators, indicated with a dotted line, can coincide. In the preferred embodiment shown, the actuators 40 are pivotably mounted onto a spinner frame 39 such that they can pivot about a pivot axis extending parallel to the main axis of the power tong. The use of linear actuators allows for a direct control of the position at which the spinner assembly is located, and of the force with which the tubular is held between the spinner assemblies.

The spinner further comprises a guide mechanism 42 comprising two L-shaped guide arms 43, which L-shaped guide arms are pivotably supported at their elbow section such that they can pivot about a guide arm pivot axis parallel to the main axis.

The L-shaped guide arms 43 each have at one end a curved and teethed couple surface 44, the center of curvature of the couple surface coinciding with the guide arm pivot axis of the respective guide arm. The guide arms 43 engage each other with said couple surfaces 44. Furthermore, at an opposite end, the L-shaped guide arms 43 are each slideable coupled with one of the assemblies 36, in the embodiment shown comprise a slot that engages a notch provided on a spinner roller support frame.

This embodiment allows for an accurate guiding of the spinner assemblies, in particular because movement of one spinner assembly is directly coupled to movement of the second spinner assembly, and thus the positon of the first spinner assembly is directly coupled to the position of the second spinner assembly.

In the embodiment shown, the spinner frame 41 is hingeable supported by the power tong support frame. The spinner 4 can be pivoted about a pivot axis parallel to the main axis, between an active position and an inactive position. Thus, the spinner can not only be moved in the vertical direction, parallel to the main axis of the power tong, but can also be moved in a direction perpendicular to the main axis.

In the active position, for example depicted in FIG. 2, the spinner rollers can engage a tubular located on the main axis of the power tong. In the inactive positon, for example depicted in FIG. 3, the spinner rollers are moved away for the main axis. Thus, the spinner can be moved away from the main axis to enable an object, for example a flange of a tubular or a device mounted onto a tubular or between two tubulars, to be lowered along the main axis without engaging the spinner assemblies.

REFERENCE SIGNS

01 power tong
02 upper tong
03 lower tong
04 spinner
05 upper tong frame
06 lower tong frame
07 tubular passage
08 radial opening
09 main axis
10 grippers
11 linear working axis gripper
12 power tong support frame
13 torque actuator
14 first hydraulic drive
15 second hydraulic drive
16 housing hydraulic drive
17 drive shaft hydraulic drive
18 drive shaft hydraulic drive
19 guide wheel hydraulic drive
20 guide track hydraulic drive
20*a* first section guide track
20*b* second section guide track
21 pinion hydraulic drive
22 rack for cooperating with the pinion of the hydraulic drive
22*a* first section rack
22*b* second section rack
23 upper tubular
24 lower tubular
25 firing line
26 lower threaded end upper tubular
27 upper threaded end lower tubular
28 inside guide surface
29 outside guide surface
30 positioning guides lower tong
31 positioning guide upper tong
32 gripper actuator part
33 gripper beak part
34 piston
35 pad
36 spinner assembly
37 spinner rollers
38 hydraulic drive
39 spinner rollers support frame
40 hydraulic actuator
41 Spinner frame
42 spinner guide mechanism
43 L-shaped guide arms
44 couple surface

The invention claimed is:

1. A power tong, adapted to apply torque to a lower tubular relative to an upper tubular, to thus connect and disconnect an upper threaded end of the lower tubular and a lower threaded end of the upper tubular, the lower tubular and upper tubular being supported on a main axis of the power tong, the power tong comprising:

a lower tong, the lower tong comprising a lower tong frame defining a central tubular passage, multiple grippers, each gripper having a linear working axis, said working axis extending perpendicular to the main axis, the grippers being distributed around the tubular passage for gripping the lower tubular in the tubular passage, and a radial opening that provides lateral access to the tubular passage for a tubular;

an upper tong, the upper tong comprising an upper tong frame defining a central tubular passage, multiple grippers, each gripper having a linear working axis said working axis extending perpendicular to the main axis, the grippers being distributed around the tubular passage for gripping the upper tubular in the tubular passage, and a radial opening that provides lateral access to the tubular passage;

a support frame, the support frame supporting the lower tong and/or the upper tong with the respective tubular passage aligned on the main axis, the upper tong being located above the lower tong; and a torque actuator, the torque actuator comprising a first hydraulic drive and a second hydraulic drive, for rotating the upper tong relative to the lower tong and about the main axis, to connect or disconnect the lower tubular gripped by the lower tong and the upper tubular gripped by the upper tong, wherein the first hydraulic drive and the second hydraulic drive each have a housing and a drive shaft extending from that housing, wherein each drive shaft supports a guide wheel for cooperating with a guide track and a pinion for cooperating with a rack, which guide wheel and pinion are concentrically mounted on the drive shaft of the hydraulic drive, and wherein the first hydraulic drive and the second hydraulic drive are mounted on the lower tong frame or are mounted on the upper tong frame, each with the drive shaft parallel to the main axis, and wherein respectively the upper tong or the lower tong comprises the guide track receiving the guide wheel and the rack cooperating with the pinion of the first hydraulic drive and the second hydraulic drive, to enable the hydraulic drives to rotate and guide the upper tong relative to the lower tong.

2. The power tong according to claim 1, wherein the lower tong and the upper tong each comprise three grippers, the tubular grippers being located, at regular intervals, around the tubular passage of the lower tong and the upper tong respectively.

3. The power tong according to claim 2, wherein the guide track comprises a first track section for cooperating with the guide wheel of the first hydraulic drive and a second guide track for cooperating with the guide wheel of the second hydraulic drive.

4. The power tong according to claim 3, wherein the rack comprises a first rack section for cooperating with the pinion of the first hydraulic drive and a second rack section for cooperating with the pinion of the second hydraulic drive.

5. The power tong according to claim 4, wherein the first hydraulic drive and the second hydraulic drive are located between the gripper actuators, such that the first track section and the second track section each extend between two gripper actuators.

6. The power tong according to claim 3, wherein the first hydraulic drive and the second hydraulic drive are located between the gripper actuators, such that the first track section and the second track section each extend between two gripper actuators.

7. A vessel or drilling platform comprising the power tong according to claim 2.

8. The power tong according to claim 1, wherein the guide track has an inside and an outside guide surface, the inside guide surface and the outside guide surface defining between them the guide track.

9. The power tong according to claim 1, wherein the lower tong frame and the upper tong frame comprise interacting positioning guides, for positioning the upper tong relative to the lower tong in at least a vertical direction.

10. The power tong according to claim 1, wherein a first plane comprising a drive axis of the first hydraulic drive and the main axis, and a second plane comprising a drive axis of the second hydraulic drive and the main axis, extend relative to each other at an angle in the range of 115-125 degrees.

11. The power tong according to claim 1, wherein for the first and the second hydraulic drive the guide wheel is located at the end of the drive shaft, and the pinion is located between the guide wheel and the housing of the hydraulic motor.

12. The power tong according to claim 11, wherein the spinner comprises a guide mechanism comprising two L-shaped guide arms, wherein the L-shaped guide arms are pivotably supported at their elbow section such that they can pivot about a guide arm pivot axis parallel to the main axis, wherein the L-shaped guide arms each have at one end a curved and teethed couple surface, the center of curvature of the couple surface coinciding with the guide arm pivot axis of the respective guide arm, and the guide arms engaging each other with said couple surfaces, and wherein the L-shaped guide arms are each at an opposite end slideable coupled with one of the spinner assemblies.

13. The power tong according to claim 1, further comprising a spinner for gripping the upper tubular, the spinner being movably supported above the upper tong by the support frame, such that the spinner can move along the main axis to move with an upper tubular while a lower threaded end thereof, or threaded pin, is spun into or is spun out off the upper threaded end, or threaded box, of the lower tubular.

14. The power tong according to claim 13, wherein the spinner is moveably supported such that the spinner can move along the main axis to move with an upper tubular while a lower threaded end thereof, or threaded pin, is spun into or is spun out off the upper threaded end, or threaded box, of the lower tubular.

15. The power tong according to claim 14, wherein the spinner comprises two spinner assemblies, each spinner assembly comprising a set of spinner rollers and at least one hydraulic drive for rotating the spinner rollers, the spinner rollers and at least one hydraulic drive being supported in a spinner rollers support frame, and wherein the spinner assemblies are each moveably supported to enable moving the sets of spinner rollers towards and away from each other, and to clamp a tubular between the two sets of spinner rollers.

16. The power tong according to claim 13, wherein the spinner comprises two spinner assemblies, each spinner assembly comprising a set of spinner rollers and at least one hydraulic drive for rotating the spinner rollers, the spinner rollers and at least one hydraulic drive being supported in a spinner rollers support frame, and wherein the spinner assemblies are each moveably supported to enable moving the sets of spinner rollers towards and away from each other, and to clamp a tubular between the two sets of spinner rollers.

17. The power tong according to claim 16, wherein the spinner assemblies are each moveably supported by a linear actuator, the linear actuators being positioned opposite each other, such that working lines of the actuators can coincide, and wherein the actuators are pivotably mounted onto a spinner frame such that they can pivot about a pivot axis extending parallel to the main axis.

18. The power tong according to claim 17, wherein the spinner frame is hingeable supported, such that the spinner frame can be pivoted between an active position in which the spinner rollers can engage a tubular located on the main axis, and an inactive position, in which the spinner rollers are away from the main axis.

19. A vessel or drilling platform comprising the power tong according to claim 1.

20. A method for connecting or disconnecting two tubulars, to make-up or break out a tubular connection, using the power tong according to claim 1.

* * * * *